US008858049B2

(12) United States Patent
Sekiguchi et al.

(10) Patent No.: US 8,858,049 B2
(45) Date of Patent: Oct. 14, 2014

(54) VEHICLE LIGHTING UNIT

(75) Inventors: Tatsuya Sekiguchi, Tokyo (JP); Kazuyuki Shimada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 277 days.

(21) Appl. No.: 13/540,580

(22) Filed: Jul. 2, 2012

(65) Prior Publication Data

US 2013/0003401 A1 Jan. 3, 2013

(30) Foreign Application Priority Data

Jun. 30, 2011 (JP) ..... 2011-146159

(51) Int. Cl.
*F21V 13/12* (2006.01)
*F21S 8/10* (2006.01)

(52) U.S. Cl.
CPC ..... *F21S 48/1388* (2013.01); *F21S 48/1159* (2013.01)
USPC ..... 362/517; 362/539

(58) Field of Classification Search
None
See application file for complete search history.

(56) References Cited

U.S. PATENT DOCUMENTS

| | | | | |
|---|---|---|---|---|
| 7,325,954 | B2 | 2/2008 | Futami | |
| 7,690,818 | B2 * | 4/2010 | Takada et al. | 362/517 |
| 8,348,486 | B2 * | 1/2013 | Nakada | 362/517 |
| 8,425,097 | B2 * | 4/2013 | Yamamoto | 362/517 |
| 8,439,539 | B2 * | 5/2013 | Yamamoto | 362/517 |
| 8,517,581 | B2 * | 8/2013 | Futami | 362/518 |
| 2009/0316423 | A1 * | 12/2009 | Futami | 362/517 |
| 2010/0110715 | A1 * | 5/2010 | Nakada | 362/538 |
| 2010/0118559 | A1 * | 5/2010 | Nakada | 362/539 |
| 2013/0083553 | A1 * | 4/2013 | Sekiguchi | 362/517 |

FOREIGN PATENT DOCUMENTS

JP 4666160 B2 4/2011

* cited by examiner

*Primary Examiner* — Britt D Hanley
(74) *Attorney, Agent, or Firm* — Kenealy Vaidya LLP

(57) ABSTRACT

A vehicle lighting unit can be configured to allow the brightnesses of light observed through vertically arranged lenses to substantially match when the lenses are viewed from a certain viewpoint in front of the vehicle. The vehicle lighting unit can include: a first lens on a first upper optical axis; a second lens on a second lower optical axis; a semiconductor light-emitting device; a first revolved ellipsoidal reflector; a shade; a second revolved ellipsoidal reflector; and a third reflector. The third reflector is inclined at an inclination angle with respect to the horizontal plane adjusted such that light emitted from the semiconductor light-emitting device, reflected by the second reflector, focused at a second focal point of the second reflector, reflected by the third reflector, and passing through the second lens is directed in a direction at a predetermined upward angle with respect to the horizontal plane.

18 Claims, 7 Drawing Sheets

VEHICLE LIGHTING UNIT

This application claims the priority benefit under 35 U.S.C. §119 of Japanese Patent Application No. 2011-146159 filed on Jun. 30, 2011, which is hereby incorporated in its entirety by reference.

TECHNICAL FIELD

The presently disclosed subject matter relates to a vehicle lighting unit, and particularly to a vehicle lighting unit including vertically arranged lenses.

BACKGROUND ART

Vehicle lamps including vertically arranged lenses have been proposed (see, for example, Japanese Patent No. 4666160 or corresponding U.S. Pat. No. 7,325,954).

As shown in FIG. 1, a vehicle lamp 200 described in Japanese Patent No. 4666160 can include vertically arranged lenses 210A and 210B, an HID bulb 220, an upper reflector 230A, a lower reflector 230B, and the like. In the vehicle lamp 200 configured as above, upward light emitted from the HID bulb 220 can be reflected by the upper reflector 230A, pass through the upper lens 210A, and then be projected toward the front. Downward light emitted from the HID bulb 220 can be reflected by the lower reflector 230B and the like, pass through the lower lens 210B, and then be projected toward the front.

In recent years, semiconductor light-emitting devices such as LEDs are receiving attention from the viewpoint of power saving and the like. In the field of vehicle lamps, it is also contemplated to use semiconductor light-emitting devices instead of HID bulbs and the like.

In general, a semiconductor light-emitting device such as an LED is said to be a light source having directional characteristics. More specifically, the luminous intensity of the light source is maximum on its optical axis and decreases as the inclination with respect to the optical axis increases (see FIG. 6). Therefore, when the HID bulb 220 is simply replaced with a semiconductor light-emitting device such as an LED, the difference between the luminous intensity (luminance) through the upper lens and that through the lower lens is noticeable when the lenses are viewed from a viewpoint in front of the vehicle (a viewpoint above a horizontal line, for example, the viewpoint of a pedestrian in front of the vehicle or the driver of an oncoming vehicle). This causes a problem in that the brightnesses observed through the lenses are different from each other.

SUMMARY

The presently disclosed subject matter was devised in view of these and other problems and features and in association with the conventional art. According to an aspect of the presently disclosed subject matter, a vehicle lighting unit can be configured to allow the brightnesses of light observed through vertically arranged lenses to substantially match (exactly or almost matching) when the lenses are viewed from a viewpoint in front of the vehicle (a certain viewpoint above a horizontal line).

According to another aspect of the presently disclosed subject matter, a vehicle lighting unit can have an upper first optical axis extending in a front-rear direction of a vehicle and a lower second optical axis extending in the front-rear direction of the vehicle and positioned below the first optical axis and can be configured to include: a first lens disposed on the first optical axis and having a focal point on a vehicle rear-side; a second lens disposed on the second optical axis and having a focal point on a vehicle rear-side; a semiconductor light-emitting device disposed on a rear side of the vehicle rear-side focal point of the first lens and configured to emit light substantially upward, the semiconductor light-emitting device having an element optical axis; a first reflector disposed above the semiconductor light-emitting device such that light emitted from the semiconductor light-emitting device in a narrow angle direction with respect to the element optical axis of the semiconductor light-emitting device is incident on the first reflector; a shade disposed between the first lens and the semiconductor light-emitting device and configured to block part of light emitted from the semiconductor light-emitting device and reflected by the first reflector; a second reflector disposed between the first lens and the first reflector such that light emitted from the semiconductor light-emitting device in a wide angle direction with respect to the element optical axis of the semiconductor light-emitting device is incident on the second reflector, the light emitted in the narrow angle direction and incident on the first reflector having a luminous intensity higher than the light emitted in the wide angle direction and incident on the second reflector does; and a third reflector disposed between the second lens and the vehicle rear-side focal point of the second lens. In this configuration, the first reflector can be a revolved ellipsoidal reflector having a first focal point at or near the semiconductor light-emitting device and a second focal point at or near the vehicle rear-side focal point of the first lens, and the second reflector can be a revolved ellipsoidal reflector having a first focal point at or near the semiconductor light-emitting device and a second focal point between the second reflector and the third reflector. Furthermore, the third reflector can be disposed to be inclined with respect to a horizontal plane such that a vehicle front-side edge of the third reflector is located below the second optical axis and a vehicle rear-side edge of the third reflector is located above the second optical axis. The second focal point of the second reflector between the second reflector and the third reflector can be located at a position symmetric to a position below the second optical axis with respect to the third reflector used as a symmetry plane, and the third reflector can be inclined at an inclination angle with respect to the horizontal plane adjusted such that light emitted from the semiconductor light-emitting device, reflected by the second reflector, focused at the second focal point of the second reflector, reflected by the third reflector, and passing through the second lens is directed in a direction at a predetermined upward angle with respect to the horizontal plane.

In the vehicle lighting unit configured as above, the inclination angle of the third reflector with respect to the horizontal plane can be adjusted such that the luminous intensities (luminances) of light observed through the first and second lenses can match (or substantially match) when the lenses are viewed from a viewpoint in front of the vehicle (a viewpoint above the horizontal line). The upward angle of the light emitted from the semiconductor light-emitting device and passing through the second lens with respect to the horizontal plane can be thereby adjusted. This can allow the brightnesses observed through the first and second lenses to match (or substantially match) when the lenses are viewed from a viewpoint in front of the vehicle (a certain viewpoint above the horizontal line).

In the above configuration of the vehicle lighting unit, the inclination angle of the third reflector with respect to the horizontal plane is adjusted such that light emitted from the semiconductor light-emitting device, reflected by the second reflector, focused at the second focal point of the second reflector, reflected by the third reflector, and passing through the second lens is directed in a direction at an upward angle of 2° to 4° with respect to the horizontal plane.

In the vehicle lighting unit configured as above, the inclination angle of the third reflector with respect to the horizontal plane can be adjusted such that the light emitted from the semiconductor light-emitting device and passing through the second lens is directed in the direction at the upward angle of 2° to 4° with respect to the horizontal plane. This not only can allow the brightnesses observed through the first and second lenses to match (or substantially match) when the lenses are viewed from a viewpoint in front of the vehicle (a viewpoint above the horizontal line) but also can allow an overhead sign region to be irradiated with light. Herein, the overhead sign region means a region that is on a virtual vertical screen disposed about 25 m ahead of the front end of the vehicle, is located above the horizontal line, and subtends 2° to 4°, and where a road guide, a road sign, etc. can be present.

In the above configurations of the vehicle lighting unit, the distance between the first lens at its lower edge and the second lens at its upper edge in the vertical direction can be 15 mm or less. In the vehicle lighting unit configured as above, the first lens and the second lens can be visually recognized as a single light-emitting region.

In the above configurations of the vehicle lighting unit, the narrow angle directions can range within ±60° with respect to the element optical axis and the wide angle directions can range outside ±60° with respect to the element optical axis.

According to the presently disclosed subject matter, a vehicle lighting unit can be provided which allows brightnesses observed through the vertically arranged lenses to match (or substantially match) when the vehicle lighting unit is viewed from a viewpoint in front of the vehicle (a certain viewpoint above the horizontal line).

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lighting units of the presently disclosed subject matter with reference to the accompanying drawings in accordance with exemplary embodiments.

In the present specification, it should be noted that the upper (upward), lower (downward), left, right, back (rearward), and front (forward) directions are based on a typical posture of a vehicle body to which the vehicle lighting unit is installed unless otherwise specified.

At least one vehicle lighting unit 10 of the present exemplary embodiment can be disposed on each of the front left and front right sides of a vehicle body, such as an automobile, and can be used as a vehicle headlight. Well-known aiming mechanisms (not shown) can be connected to the respective vehicle lighting units 10 so that their optical axes can be adjusted.

Figure 1:
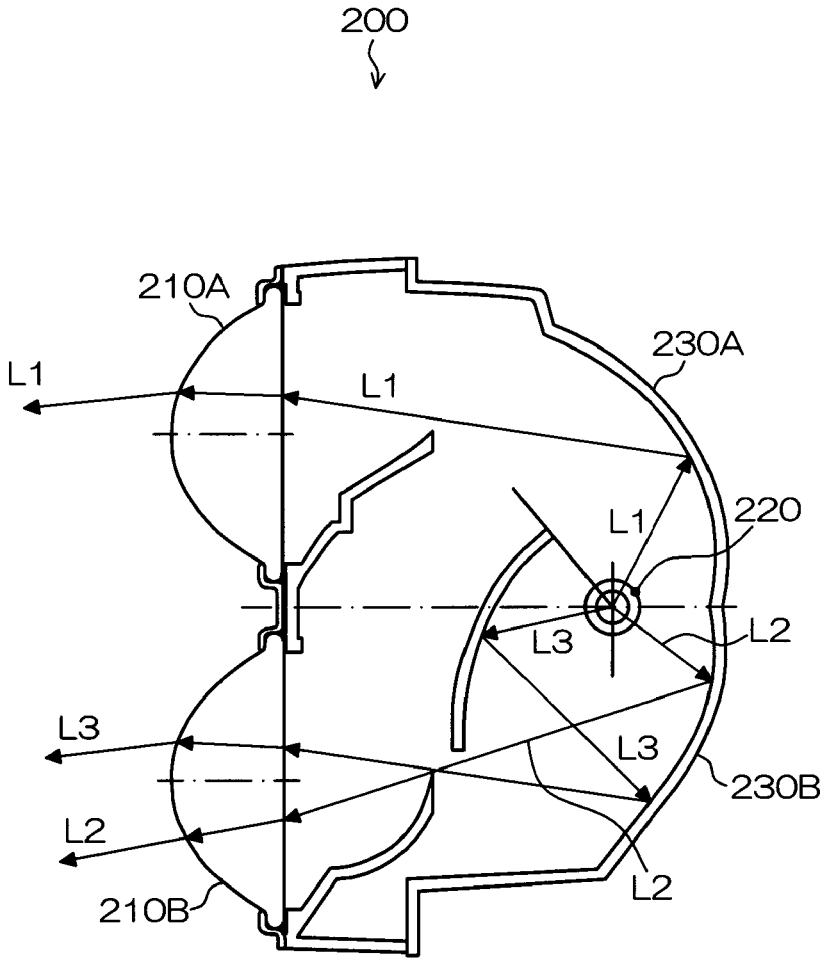
Fig. 1 Conventional Art
FIG. 1 is a vertical cross-sectional view of a conventional vehicle lamp 200 taken along a vertical plane including the optical axis thereof.
Figure 2:
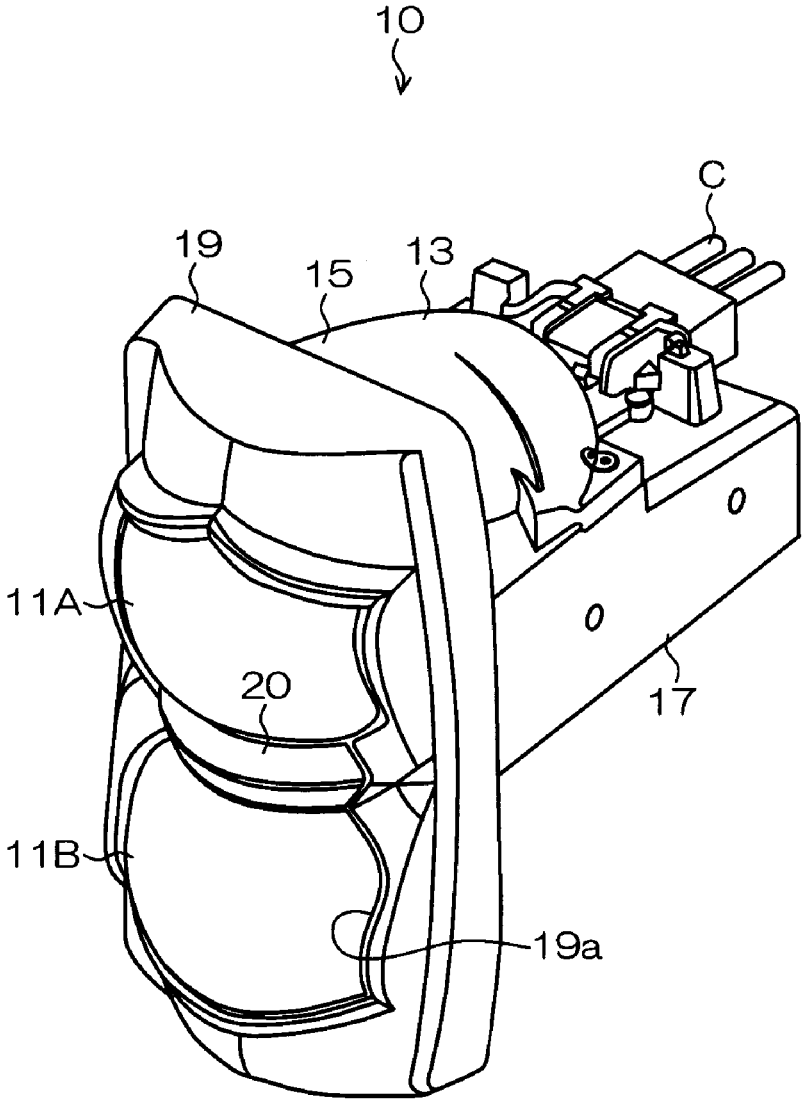
FIG. 2 is a perspective view of a vehicle lighting unit in an exemplary embodiment made in accordance with principles of the presently disclosed subject matter.
Figure 3:
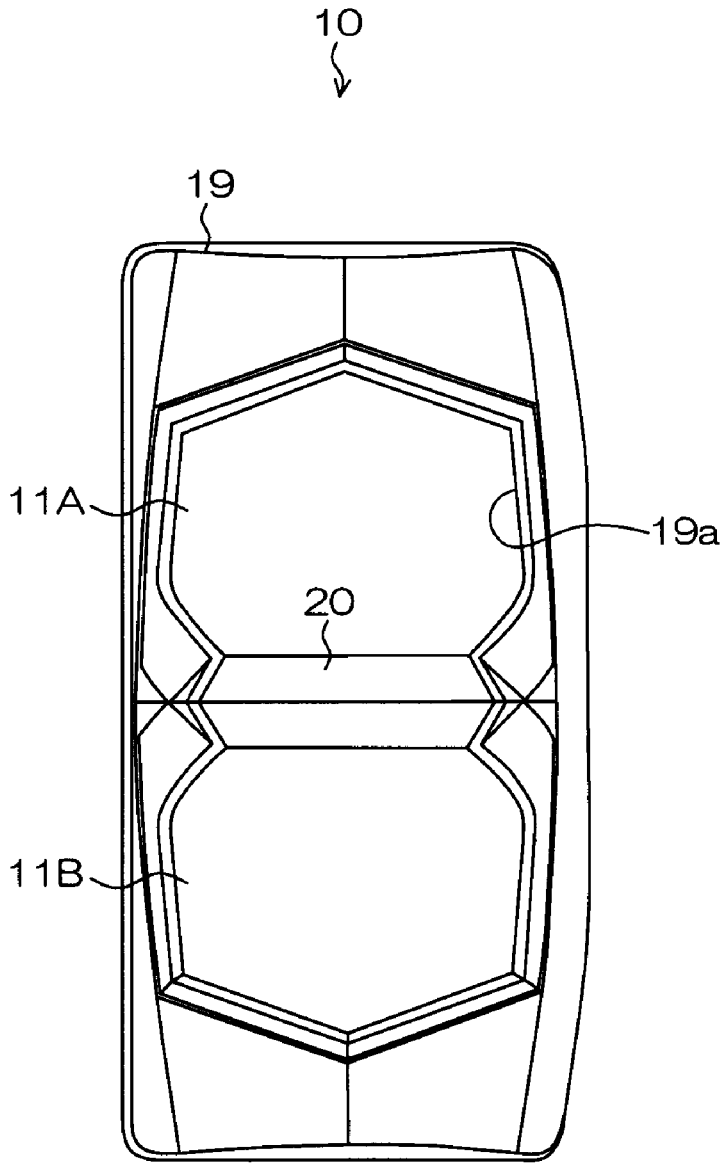
FIG. 3 is a front view of the vehicle lighting unit of FIG. 2.
Figure 4:
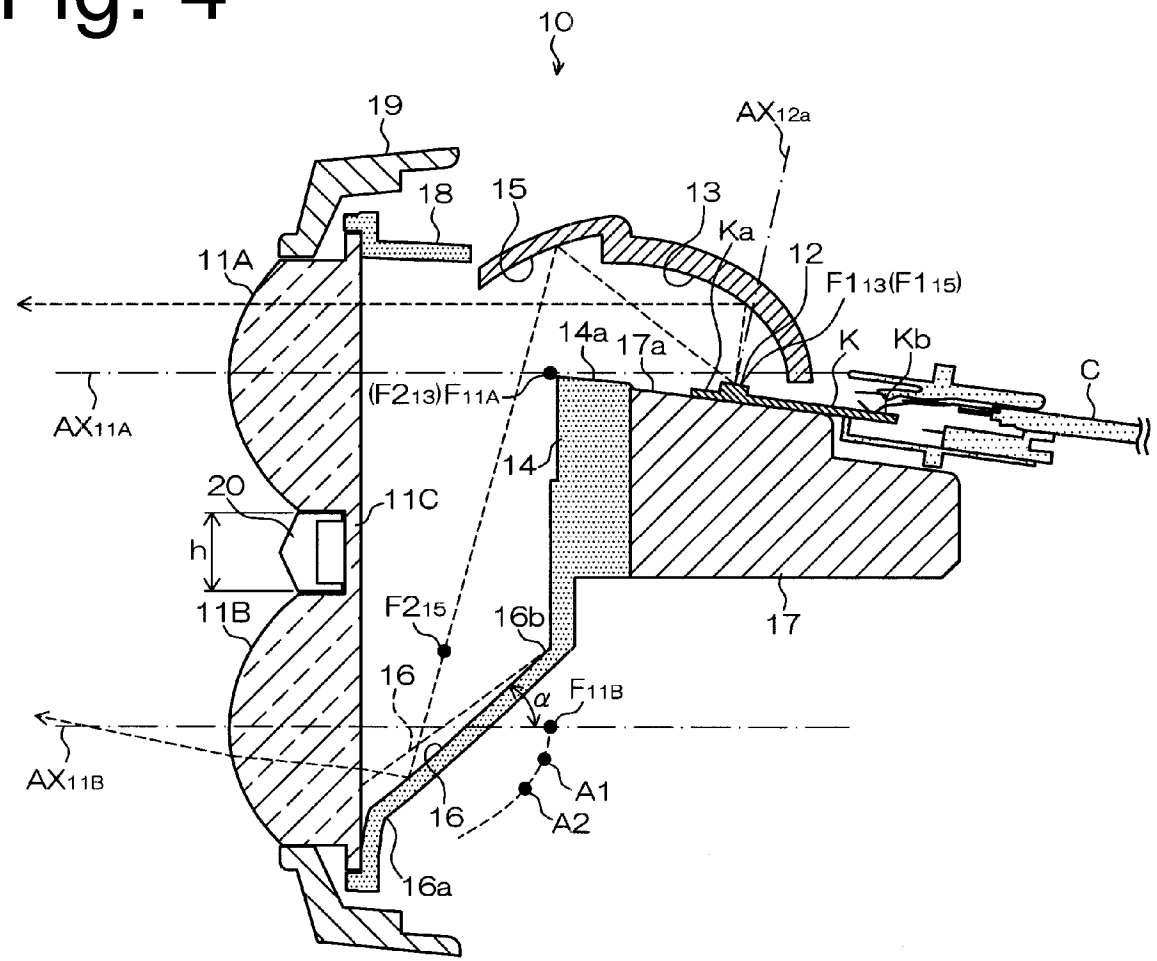
FIG. 4 is a vertical cross-sectional view of the vehicle lighting unit taken along a vertical plane including a first optical axis $AX_{11A}$ and a second optical axis $AX_{11B}$ of the vehicle lighting unit of FIG. 2.

FIG. 2 is a perspective view of the vehicle lighting unit 10, and FIG. 3 is a front view thereof. FIG. 4 is a vertical cross-sectional view of the vehicle lighting unit 10 taken along a vertical plane including the upper first optical axis $AX_{11A}$ extending in a front-rear direction of the vehicle and a lower second optical axis $AX_{11B}$ extending in the front-rear direction.

As shown in FIGS. 2 to 4, the vehicle lighting unit 10 can be a projector-type lamp unit configured to form a low-beam light distribution pattern. The vehicle lighting unit 10 can include: a first lens 11A having a focal point $F_{11A}$ on a vehicle rear-side; a second lens 11B disposed below the first lens 11A and having a focal point $F_{11B}$ on the vehicle rear-side; a semiconductor light-emitting device 12 disposed on the rear side of the vehicle rear-side focal point $F_{11A}$ of the first lens 11A and positioned at or near the first optical axis $AX_{11A}$; a first reflector 13 disposed above the semiconductor light-emitting device 12; a shade 14 disposed between the first lens 11A and the semiconductor light-emitting device 12 and configured to block part of the light emitted from the semiconductor light-emitting device 12 and reflected by the first reflector 13; a second reflector 15 disposed between the first lens 11A and the first reflector 13; a third reflector 16 disposed between the second lens 11B and the vehicle rear-side focal point $F_{11B}$ thereof; a heat sink 17; a lens holder 18; an extension 19 used as a decoration member; a decoration member 20; etc.

As shown in FIG. 4, the first lens 11A can be held by the lens holder 18 secured to the heat sink 17 and be disposed on the upper first optical axis $AX_{11A}$ extending in the front-rear direction of the vehicle. Similarly, the second lens 11B can be held by the lens holder 18, be disposed on the lower second optical axis $AX_{11B}$ extending in the front-rear direction of the vehicle, and be placed at a position below the first lens 11A with a separation distance h therefrom. The distance h is desirably 15 [mm] or less (for example, 10 [mm]). With this configuration, the first lens 11A and the second lens 11B can be visually recognized as a single light-emitting region.

The respective optical axes $AX_{11A}$ and $AX_{11B}$ are contained in a single vertical plane and extend in a substantially horizontal direction. Therefore, the respective lenses 11A and 11B can be visually recognized such that they are arranged in a vertical direction and directed in the same direction. The second optical axis $AX_{11B}$ may be slightly inclined with respect to a horizontal plane such that the axis $AX_{11B}$ is higher (or lower) on the front side of the vehicle than on the rear side. In this case, the respective lenses 11A and 11B can be visually recognized such that they are arranged vertically and directed in different directions. The respective optical axes $AX_{11A}$ and $AX_{11B}$ may not be contained in a single vertical plane but may be contained in different vertical planes. In this case, the respective lenses 11A and 11B can be visually recognized such that they are arranged in a vertically diagonal direction.

Each of the lenses 11A and 11B can be, for example, a plano-convex aspherical projection lens having a convex surface on the front side thereof and a flat surface on the rear side thereof. The first lens 11A and the second lens 11B can be formed as projection lenses having the same shape, the same size, and the same focal length. However, the first lens 11A and the second lens 11B may be formed as projection lenses having different shapes, different sizes, and different focal lengths.

In the present exemplary embodiment, each of the lenses 11A and 11B can have an outer circumference cut into a hexagonal shape as viewed from the front (see FIG. 3). The respective lenses 11A and 11B may be projection lenses having circular, ellipsoidal, or n-sided polygonal (n is an integer of 3 or larger) shapes or other shapes.

The first lens 11A and the second lens 11B can be molded integrally by injecting a transparent resin (such as an acrylic resin or polycarbonate) into a mold and cooling the resin to solidify it, so that both the first lens 11A and the second lens 11B can be configured as a single continuous integral member. This allows a reduction in the number of components, simplification of the step of attaching the respective lenses 11A and 11B, a reduction in attachment errors of the respective lenses 11A and 11B, etc. as compared to the case where the first lens 11A and the second lens 11B are configured as independent components. The first lens 11A and the second lens 11B may not be molded integrally but may be configured as independent components according to intended applications.

The respective lenses 11A and 11B can appear through an opening 19*a* formed in the extension 19, and their outer circumferential edges can be covered with the extension 19.

A recess 11C extending horizontally (in a direction perpendicular to the sheet of FIG. 4) can be formed between the lower end of the first lens 11A and the upper end of the second lens 11B. The decoration member 20 extending horizontally can be disposed in the recess 11C. The surface of the decoration member 20 may have been subjected to minor finish processing such as vapor deposition of aluminum. The decoration member 20 can be secured to the recess 11C by well-known attaching means such as bonding or fitting. The heights of the recess 11C and the decoration member 20 may be equal to or lower than the distance h (for example, 10 mm).

Figure 5:
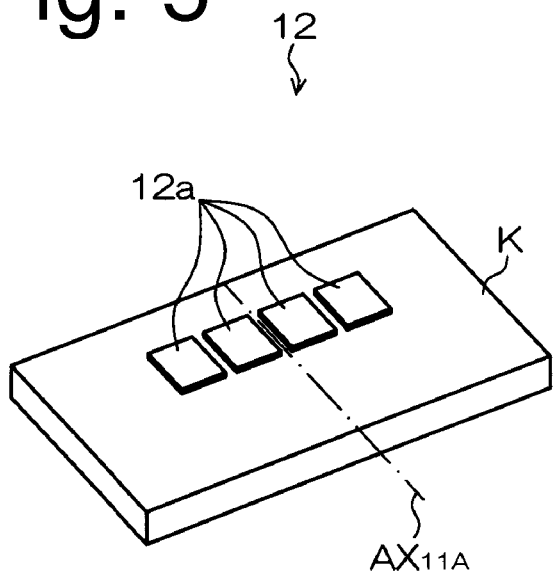
FIG. 5 is a perspective view of a semiconductor light-emitting device.

FIG. 5 is a perspective view of the semiconductor light-emitting device 12 for use in the vehicle lighting unit 10.

The semiconductor light-emitting device 12 can be, for example, a single light source in which a plurality of LED chips 12*a* (for example, four 1 mm-square blue LED chips) are packaged. Each of the LED chips 12*a* may be covered with a phosphor (for example, a YAG phosphor (a yellow phosphor)). The number of LED chips 12*a* is not limited to 4 and may be 1 to 3, or 5 or more.

The respective LED chips 12*a* can be mounted on a substrate K secured to the upper surface 17*a* of the heat sink 17 such that light is emitted substantially upward (in the illustrated example, the light is emitted in a diagonally rearward and upward direction shown in FIG. 4). The LED chips 12*a* can be disposed on the rear side of the vehicle rear-side focal point $F_{11A}$ of the first lens 11A and placed at or near (i.e., substantially at) the first optical axis $AX_{11A}$. As shown in FIG. 5, the LED chips 12*a* can be arranged in a row (in a direction perpendicular to the sheet of FIG. 4) at predetermined intervals with their edges along a horizontal line orthogonal to the first optical axis $AX_{11A}$ so as to be symmetric with respect to the first optical axis $AX_{11A}$.

The substrate K can be disposed so as to be inclined with respect to the horizontal plane with the vehicle front end side Ka of the substrate K being higher than its vehicle rear end side Kb (see FIG. 4). Therefore, the element optical axes $AX_{12a}$ of the LED chips 12*a* can be diagonally rearward and upward. It should be appreciated that the substrate K may be disposed horizontally such that the vehicle front end side Ka and the vehicle rear end side Kb are on the same horizontal plane.

A power cable C can be electrically connected to the semiconductor light-emitting device 12. The semiconductor light-emitting device 12 can be energized when a constant current is supplied thereto through the power cable C, thereby emitting light. The heat generated by the semiconductor light-emitting device 12 can be dissipated through the action of the heat sink 17.

Figure 6:
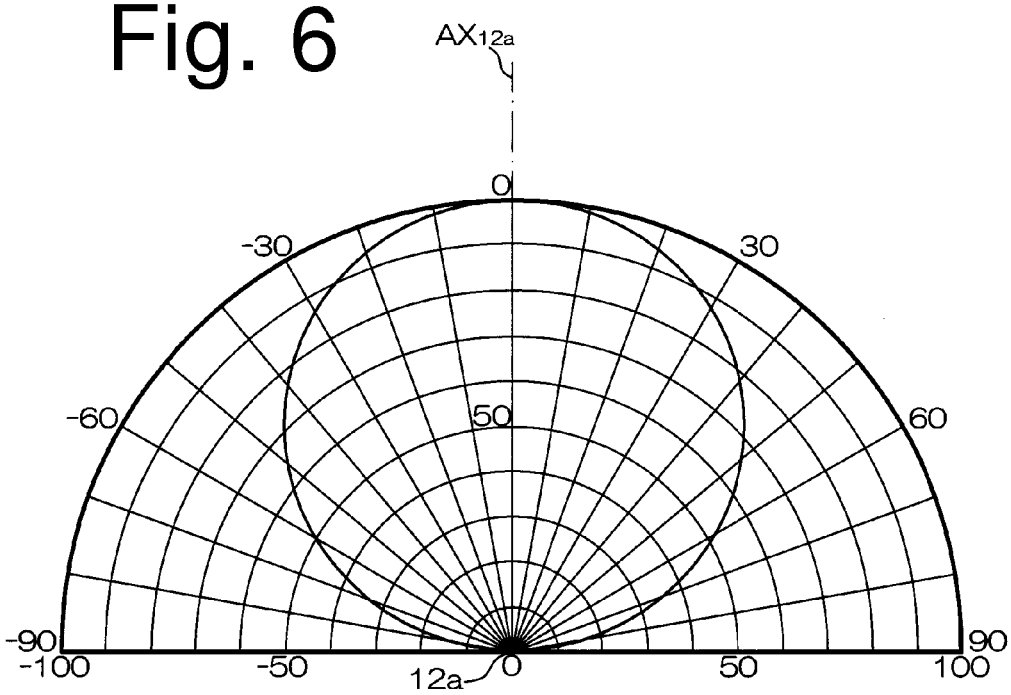
FIG. 6 shows an example of the directional characteristics of an LED chip in the semiconductor light-emitting device of FIG. 5.

FIG. 6 shows an example of the directional characteristics of one of the LED chips 12*a* in the semiconductor light-emitting device 12.

The directional characteristics mean the ratio of the luminous intensity in a direction inclined at a given angle with respect to the element optical axis $AX_{12a}$ of the LED chip 12*a* in the semiconductor light-emitting device 12 with the luminous intensity on the element optical axis $AX_{12a}$ of the LED chip 12*a* being set to 100%. The directional characteristics represent the spread of light emitted from the LED chip 12*a* in the semiconductor light-emitting device 12. The angle at which the ratio of luminous intensity is 50% is a half-value angle. In FIG. 6, the half-value angle is ±60°.

The semiconductor light-emitting device 12 is not limited to include the LED chips 12*a* so long as it is a light source device including surface light-emitting chips used substantially as point light-emitting chips. For example, the semiconductor light-emitting device 12 may include light-emitting diodes or laser diodes other than LED chips.

As shown in FIG. 4, the first reflector 13 can be a revolved ellipsoidal reflector (for example, a revolved ellipsoidal surface or a free curved surface similar thereto) that has a first focal point $F1_{13}$ at or near (i.e., substantially at) the semiconductor light-emitting device 12 and a second focal point $F2_{13}$ at or near (i.e., substantially at) the vehicle rear-side focal point $F_{11A}$ of the first lens 11A.

The first reflector 13 can extend from one side of the semiconductor light-emitting device 12 (from the vehicle rear side in FIG. 4) toward the first lens 11A and cover the semiconductor light-emitting device 12 from above. The first reflector 13 can be designed such that relatively high luminous intensity light emitted substantially upward from the semiconductor light-emitting device 12 in narrow angle directions with respect to the element optical axis $AX_{12a}$ of the semiconductor light-emitting device 12 (for example, light within about the half value angles (namely, light within ±60° in FIG. 6)) can be incident on the first reflector 13.

Figure 7:
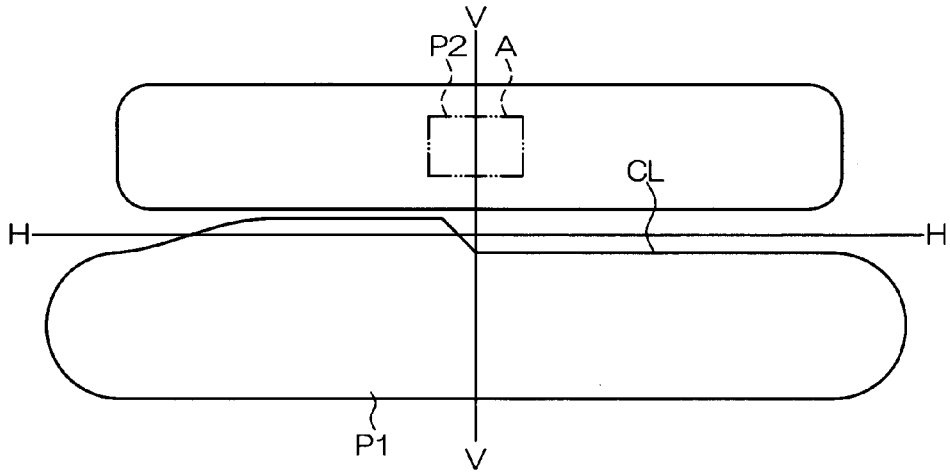
FIG. 7 shows examples of a low-beam distribution pattern P1 and an overhead sign light distribution pattern P2 that are formed by the vehicle lighting unit of FIG. 2.

The shade 14 can include a minor surface 14*a* extending from the vehicle rear-side focal point $F_{11A}$ of the first lens 11A toward the semiconductor light-emitting device 12. The front edge of the shade 14 can be curved and concaved along a plane that includes the vehicle rear-side focal point of the first lens 11A. The light incident on the minor surface 14*a* and reflected upward can be refracted by the first lens 11A and directed toward a road surface. More specifically, the light incident on the mirror surface 14*a* can change its travelling direction so as to be directed below a cut-off line and is superposed onto a light distribution pattern below the cut-off line. In this manner, a low-beam light distribution pattern P1 including the cut-off line CL can be formed as shown in FIG. 7.

The second reflector 15 can be a revolved ellipsoidal reflector (for example, a revolved ellipsoidal surface or a free curved surface similar thereto) that can have a first focal point $F1_{15}$ at or near (i.e., substantially at) the semiconductor light-emitting device 12 and a second focal point $F2_{15}$ between the second reflector 15 and the third reflector 16.

The second reflector 15 can extend from near the front end of the first reflector 13 toward the first lens 11A and be disposed between the first lens 11A and the first reflector 13. The second reflector 15 can be designed such that relatively low luminous intensity light emitted substantially upward from the semiconductor light-emitting device 12 in wide angle directions with respect to the element optical axis $AX_{12a}$ of the semiconductor light-emitting device 12 (for example, light outside values near the half value angles (namely, light outside ±60° in FIG. 6)) is incident on the second reflector 15. It should be noted that the light emitted in the narrow angle directions and incident on the first reflector can have a luminous intensity higher than does the light emitted in the wide angle directions and incident on the second reflector. The second reflector 15 can have a length that is set such that the front end thereof does not block the light reflected by the first reflector 13 and which is incident on the first lens 11A.

The first reflector 13 and the second reflector 15 can be configured as a single continuous member and formed by subjecting a reflector base material molded integrally using a mold to minor finish processing such as vapor deposition of aluminum. This allows a reduction in the number of components, simplification of the step of attaching the reflectors 13 and 15, a reduction in attachment errors of the reflectors 13 and 15, etc., as compared to the case where the reflectors 13 and 15 are configured as independent components. The first reflector 13 and the second reflector 15 may not be molded integrally but may be configured as independent components according to intended applications.

The second focal point $F2_{15}$ of the second reflector 15 can be set in consideration mainly of the following two physical phenomena.

Figure 8:
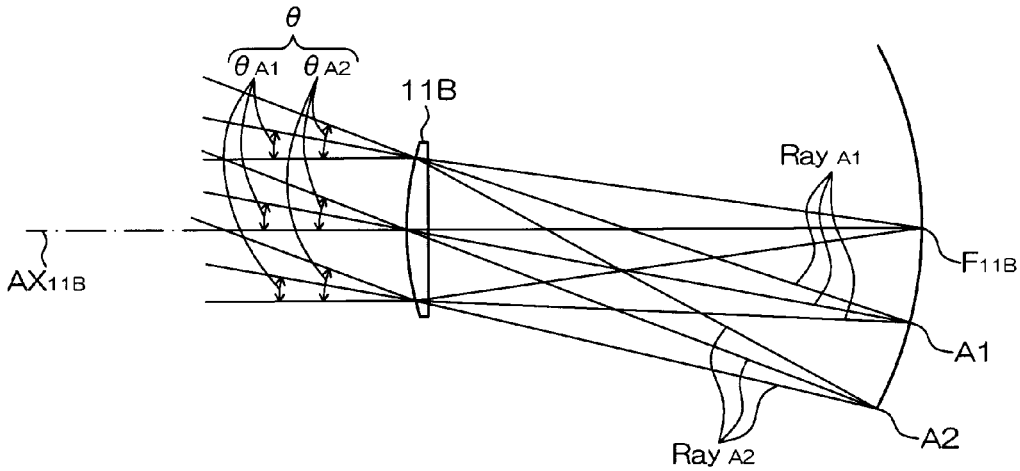
FIG. 8 is a diagram illustrating that, in the lighting unit of FIG. 2, when a point light source is disposed below the second optical axis $AX_{11B}$ of a second lens and at or near the vehicle rear-side focal plane of the second lens, all the rays of light emitted from the point light source and passing through the second lens are directed in a direction at an upward angle θ with respect to the second optical axis $AX_{11B}$.

First, when a point light source is disposed at a position below the second optical axis $AX_{11B}$ of the second lens 11B and at or near (i.e., substantially at) the vehicle rear-side focal plane of the second lens 11B as shown in FIG. 8, all the rays of light emitted from the point light source and passing through the second lens 11B can be directed in a direction at an upward angle θ with respect to the horizontal plane. Second, the angle θ can be determined on the basis of the distance from the vehicle rear-side focal point $F_{11B}$ of the second lens 11B to the point light source. For example, when a point light source is disposed at a position A1 at or near (i.e., substantially at) the vehicle rear-side focal plane of the second lens 11B in FIG. 8, all the light rays $Ray_{A1}$ emitted from the point light source at the position A1 and passing through the second lens 11B can be directed in a direction at an upward angle $\theta_{A1}$ (for example, 5°) with respect to the horizontal plane. For example, when a point light source is disposed at a position A2 at or near (i.e., substantially at) the vehicle rear-side focal plane of the second lens 11B in FIG. 8, all the light rays $Ray_{A2}$ emitted from the point light source at the position A2 and passing through the second lens 11B can be directed in a direction at an upward angle $\theta_{A2}$ (for example, 10°) with respect to the horizontal plane.

On the basis of the above physical phenomena, the second focal point $F2_{15}$ of the second reflector 15 can be set as follows.

First, the position of a point light source should be set such that the upward angle θ of the rays of light passing through the second lens 11B with respect to the second optical axis $AX_{11B}$ becomes a target angle (for example, 5°) (for example, the position A1 below the second optical axis $AX_{11B}$ is selected). Next, a position symmetric to the above-selected position (for example, the position A1) with respect to the third reflector 16 used as a symmetry plane (see the third reflector 16 depicted by solid lines in FIG. 4) should be set as the second focal point $F2_{15}$ of the second reflector 15 (see FIG. 4).

When the second focal point $F2_{15}$ is set as described above, the light emitted from the semiconductor light-emitting device 12, reflected by the second reflector 15, focused at the second focal point $F2_{15}$, reflected by the third reflector 16, and then passing through the second lens 11B can travel along the same optical path as that of the light emitted from a semiconductor light-emitting device 12 (assumed to be) disposed at the position A1 and passing through the second lens 11B. More specifically, all the rays of light emitted from the semiconductor light-emitting device 12, reflected by the second reflector 15, focused at the second focal point $F2_{15}$, reflected by the third reflector 16, and then passing through the second lens 11B can be directed in a direction at an upward angle $\theta_{A1}$ (for example, 5°) with respect to the horizontal plane. The second lens 11B can thereby be visually recognized such that the entire part thereof emits light. The semiconductor light-emitting device 12 is actually not a point light source but has a certain size. Accordingly, the light emitted from the semiconductor light-emitting device 12 and passing through the second lens 11B may be spread.

The third reflector 16 can be disposed between the second lens 11B and its vehicle rear-side focal point $F_{11B}$ so that the light reflected by the second reflector 15 and focused at the second focal point $F2_{15}$ can be incident on the third reflector 16.

The third reflector 16 can be, for example, a flat mirror and can be disposed so as to be inclined with respect to the horizontal plane such that the vehicle front-side edge 16*a* of the third reflector 16 is located below the second optical axis $AX_{11B}$ and the vehicle rear-side edge 16*b* thereof is located above the second optical axis $AX_{11B}$ (see FIG. 4).

A description will next be given of an example of the adjustment of the upward angle θ of the rays of light passing through the second lens 11B with respect to the second optical axis $AX_{11B}$.

When the third reflector 16 is inclined to the position illustrated by the solid lines in FIG. 4, the position symmetric to the second focal point $F2_{15}$ of the second reflector 15 with respect to the third reflector 16 at the position illustrated by the solid lines is a position A1 below the second optical axis $AX_{11B}$.

In this case, all the rays of light emitted from the semiconductor light-emitting device 12, reflected by the second reflector 15, focused at the second focal point $F2_{15}$, reflected by the third reflector 16, and then passing through the second lens 11B can be directed in a direction at an upward angle $\theta_{A1}$ (for example, 5°) with respect to the horizontal plane (see FIGS. 4 and 8).

When the third reflector 16 is inclined to a position illustrated by a dotted line as shown in FIG. 4, the point symmetric to the second focal point $F2_{15}$ with respect to the third reflector 16 at the position depicted by the dotted line may move to a position A2 lower than the position A1.

In this case, the rays of light emitted from the semiconductor light-emitting device 12, reflected by the second reflector 15, focused at the second focal point $F2_{15}$, reflected by the third reflector 16, and then passing through the second lens 11B can travel along the same optical path as that of the rays of light emitted from a semiconductor light-emitting device 12 (assumed to be) disposed at the position A2 and passing through the second lens 11B. More specifically, all the rays of light emitted from the semiconductor light-emitting device 12, reflected by the second reflector 15, focused at the second focal point $F2_{15}$, reflected by the third reflector 16, and then passing through the second lens 11B can be directed in a direction at an upward angle $\theta_{A2}$ (for example, 10°) with respect to the horizontal plane (see FIGS. 4 and 8).

As described above, by adjusting the inclination angle α of the third reflector 16 with respect to the horizontal plane (see FIG. 4), the upward angle θ of the rays of light passing through the second lens 11B with respect to the horizontal plane can be adjusted. A description will next be given of an exemplary method for matching (or substantially matching) brightnesses observed through the first lens 11A and the second lens 11B.

As described above, the light emitted from the semiconductor light-emitting device 12, reflected by the second reflector 15, focused at the second focal point $F2_{15}$, reflected by the third reflector 16, and then passing through the second lens 11B can be relatively low luminous intensity light emitted from the semiconductor light-emitting device 12 substantially upward in wide angle directions with respect to the element optical axis $AX_{12a}$ of the semiconductor light-emitting device 12 (for example, light that is outside values near the half value angles (namely, light outside ±60° in FIG. 6)).

When the vehicle lighting unit is viewed from a viewpoint in front of the vehicle (a viewpoint above a horizontal line H-H, for example, the viewpoint of a pedestrian in front of the vehicle or the driver of an oncoming vehicle), glare light can be observed through the first lens 11A. The glare light means stray light, and examples of the stray light may include light reflected by the surface of the first lens 11A near the semiconductor light-emitting device 12, then repeatedly reflected by the surface of the shade 14, the reflectors (the first reflector 13 and the second reflector 15), and a housing, and appearing above the horizontal line H-H.

Therefore, in this case the difference between luminous intensities (luminances) of light through the first and second lenses 11A and 11B may become significant when the lenses are viewed from a viewpoint in front of the vehicle (a viewpoint above the horizontal line H-H, for example, the viewpoint of a pedestrian in front of the vehicle or the driver of an oncoming vehicle). This causes a problem in that the brightnesses observed through the lenses 11A and 11B are different from each other.

In the present exemplary embodiment, in consideration of the above problem, the brightnesses observed through the lenses 11A and 11B can be matched (or substantially matched) as follows.

Figure 9:
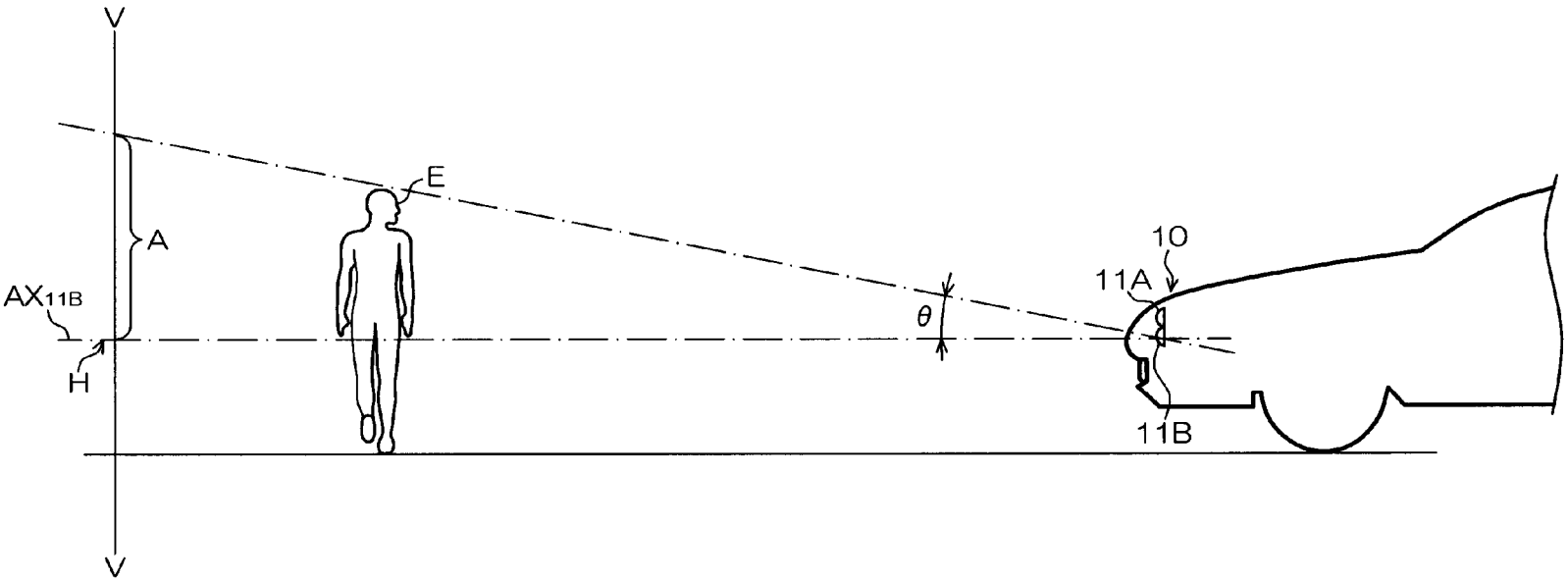
FIG. 9 shows an example of a virtual viewpoint E that is set to allow brightnesses observed through the first lens and second lens to match.

First, a virtual viewpoint E in front of the vehicle (a viewpoint above the horizontal line H-H) is set as shown in FIG. 9. Next, the luminous intensity (luminance) through the first lens 11A when it is viewed from the virtual viewpoint E is determined. Then the inclination angle α of the third reflector 16 with respect to the horizontal plane can be adjusted such that the luminous intensities (luminances) through the first and second lenses 11A and 11B match (or substantially match) when they are viewed from the virtual viewpoint E. The upward angle θ of the light emitted from the semiconductor light-emitting device 12 and passing through the second lens 11B with respect to the horizontal plane can thereby be adjusted.

For example, when the luminous intensity through the first lens 11A when it is viewed from the virtual viewpoint E is 300 [cd], the inclination angle α of the third reflector 16 with respect to the horizontal plane can be adjusted such that the luminous intensity through the second lens 11B when it is viewed from the virtual viewpoint E matches (or substantially matches) the luminous intensity (300 [cd]) through the first lens 11A when it is viewed from the virtual viewpoint E. The upward angle θ of the light emitted from the semiconductor light-emitting device 12 and passing through the second lens 11B with respect to the horizontal plane can thereby be adjusted.

As described above, the inclination angle α of the third reflector 16 with respect to the horizontal plane can be adjusted so as to adjust the upward angle θ of the light emitted from the semiconductor light-emitting device 12 and passing through the second lens 11B with respect to the horizontal plane. In this manner, the brightnesses observed through the first and second lenses 11A and 11B can be matched (or substantially matched) when they are viewed from the virtual viewpoint E in front of the vehicle (the viewpoint above the horizontal line H-H).

When an actual viewpoint moves to a point ahead of or behind the virtual viewpoint E, the difference between the luminous intensities (luminances) through one of the lenses (for example, the first lens 11A) and the other lens (for example, the second lens 11B) when the lenses are viewed from the moved viewpoint increases as the distance between the moved viewpoint and the virtual viewpoint E increases. However, since the upward angle θ has been adjusted as described above in the present exemplary embodiment, the change in the brightnesses observed through the lenses 11A and 11B may not be as much as the change when the angle θ is not adjusted.

An exemplary working range for angle θ will next be described.

The angle θ may be adjusted such that the emission direction of light passing through the second lens 11B substantially matches the viewing direction of a pedestrian in front of the vehicle or the driver of an oncoming vehicle. This allows the brightnesses observed through the first and second lenses 11A and 11B to match (or substantially match) when the lenses are viewed from a viewpoint in front of the vehicle (a viewpoint above the horizontal line H-H, for example, the viewpoint of a pedestrian in front of the vehicle or the driver of an oncoming vehicle). The angle θ can be adjusted within the range of 0° (exclusive) to 6° (for example, (4°±2°) in which the emission direction of the light substantially matches the viewing direction of the driver etc. and the amount of glare light (stray light) from the first lens 11A is relatively large. In this angle range, brightnesses observed from the area in which a pedestrian in front of the vehicle and the driver of an oncoming vehicle often view the vehicle lamp can be matched.

The angle θ can also be adjusted to an angle (ranging from 2° to 4°) at which the emission direction of the light passing through the second lens 11B is directed toward an overhead sign region A (see FIG. 7). This not only allows the brightnesses observed through the first and second lenses 11A and 11B to match (or substantially match) when they are viewed from a viewpoint in front of the vehicle (a viewpoint above the horizontal line H-H, for example, the viewpoint of a pedestrian in front of the vehicle or the driver of an oncoming vehicle) but also allows the overhead sign region A to be irradiated with the light. The overhead sign region A means a region that is on a virtual vertical screen disposed about 25 m ahead of the front end of the vehicle, is located above the horizontal line, and subtends 2° to 4°, and where a road guide, a road sign, etc. is present (see FIG. 7).

When the light passing through the second lens 11B cannot be projected onto the entire overhead sign region A, a concave or hollow reflector (or a free curved surface, etc., similar thereto) facing the second lens 11B can be used as the third reflector 16 to diffuse the light passing through the second lens 11B vertically and/or horizontally. In this manner, the entire overhead sign region A can be irradiated.

A description will next be given of an exemplary method of adjusting the luminous intensity of light above the horizontal line H-H.

Since the region above the horizontal line H-H is irradiated with the light from the respective lenses 11A and 11B, the luminous intensity in the region above the horizontal line H-H may exceed a specific value (for example, 625 [cd]).

In such a case, a concave or hollow reflector (or a free curved surface, etc., similar thereto) facing the second lens 11B is used as the third reflector 16 to diffuse the light passing through the second lens 11B vertically and/or horizontally. In this manner, the luminous intensity in the region above the horizontal line H-H can be adjusted to be equal to or lower than the specific value (for example, 625 [cd]). By adjusting the length of the second reflector 15 in the direction of the first optical axis $AX_{11A}$, the luminous intensity in the region above the horizontal line H-H can also be adjusted to be equal to or lower than the specific value (for example, 625 [cd]). In this manner, the luminous intensity in the region above the horizontal line H-H can be adjusted to be equal to or lower than, for example, the upper limit (for example, 625 [cd]) required in Europe (ECE regulations).

With the vehicle lighting unit 10 configured as described above, the light emitted from the semiconductor light-emitting device 12 and incident on the first reflector 13 can be reflected by the first reflector 13, be focused in the vicinity of the vehicle rear-side focal point $F_{11A}$ of the first lens 11A, pass through the first lens 11A, and then be projected toward the front. The low-beam light distribution pattern P1 containing the cut-off line CL is thereby formed on the virtual vertical screen (which is, for example, disposed about 25 m ahead of the front end of the vehicle), as shown in FIG. 7.

The light emitted from the semiconductor light-emitting device 12 and incident on the second reflector 15 can be reflected by the second reflector 15, be focused at the second focal point $F2_{15}$, be reflected by the third reflector 16, pass through the second lens 11B, and then be directed in a direction at an upward angle θ with respect to the horizontal plane (for example, in the range of 2° to 4°). An overhead sign light distribution pattern P2 can thereby be formed in the overhead sign region A on the virtual vertical screen (which is, for example, disposed about 25 m ahead of the front end of the vehicle), as shown in FIG. 7.

The optical axes of the vehicle lighting unit 10 have been adjusted using well-known aiming mechanisms (not shown) such that the respective light distribution patterns P1 and P2 are projected onto proper regions on the virtual vertical screen.

As described above, in the vehicle lighting unit 10 of the present exemplary embodiment, the inclination angle α of the third reflector 16 with respect to the horizontal plane can be adjusted such that the luminous intensities (luminances) of light through the first and second lenses 11A and 11B match (or substantially match) when the lenses are viewed from a viewpoint in front of the vehicle (a viewpoint above the horizontal line H-H). The upward angle θ of the light emitted from the semiconductor light-emitting device 12 and passing through the second lens 11B with respect to the horizontal plane can thereby be adjusted. This allows the brightnesses observed through the first and second lenses 11A and 11B to match (or substantially match) when the lenses are viewed from a viewpoint in front of the vehicle (a viewpoint above the horizontal line H-H).

In the vehicle lighting unit 10 in the present exemplary embodiment, the inclination angle α of the third reflector 16 with respect to the horizontal plane has been adjusted such that the light emitted from the semiconductor light-emitting device 12 and passing through the second lens 11B is directed in a direction at an upward angle (θ=2° to 4°) with respect to the horizontal plane. This not only allows the brightnesses observed through the first and second lenses 11A and 11B to match (or substantially match) when they are viewed from a viewpoint in front of the vehicle (a viewpoint above the horizontal line H-H) but also allows the overhead sign region A to be irradiated.

In the vehicle lighting unit 10 in the present exemplary embodiment, since the vertical distance between the lower end of the first lens 11A and the upper end of the second lens 11B can be set to 15 mm or less, the first lens 11A and the second lens 11B can be visually recognized as a single light-emitting region.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit having an upper first optical axis extending in a front-rear direction of a vehicle and a lower second optical axis extending in the front-rear direction of the vehicle and positioned below the first optical axis, the vehicle lighting unit comprising:

a first lens disposed on the first optical axis and having a focal point on a vehicle rear-side of the first lens;

a second lens disposed on the second optical axis and having a focal point on a vehicle rear-side of the second lens;

a semiconductor light-emitting device disposed on a rear side of the vehicle rear-side focal point of the first lens and configured to emit light substantially upward, the semiconductor light-emitting device having an element optical axis;

a first reflector disposed above the semiconductor light-emitting device such that light emitted from the semiconductor light-emitting device in a narrow angle direction with respect to the element optical axis of the semiconductor light-emitting device is incident on the first reflector;

a shade disposed between the first lens and the semiconductor light-emitting device and configured to block part of light emitted from the semiconductor light-emitting device and reflected by the first reflector;

a second reflector disposed between the first lens and the first reflector such that light emitted from the semiconductor light-emitting device in a wide angle direction with respect to the element optical axis of the semiconductor light-emitting device is incident on the second reflector, the light emitted in the narrow angle direction and incident on the first reflector having a luminous intensity higher than does the light emitted in the wide angle direction and incident on the second reflector; and a third reflector disposed between the second lens and the vehicle rear-side focal point of the second lens, wherein the first reflector includes a revolved ellipsoidal reflector having a first focal point substantially at the semiconductor light-emitting device and a second focal point substantially at the vehicle rear-side focal point of the first lens, the second reflector includes a revolved ellipsoidal reflector having a first focal point substantially at the semiconductor light-emitting device and a second focal point between the second reflector and the third reflector, the third reflector is inclined with respect to a horizontal plane such that a vehicle front-side edge of the third reflector is located below the second optical axis and a vehicle rear-side edge of the third reflector is located above the second optical axis, the second focal point of the second reflector between the second reflector and the third reflector is located at a position symmetric to a position below the second optical axis with respect to the third reflector used as a symmetry plane, and the third reflector is inclined at an inclination angle with respect to the horizontal plane adjusted such that light emitted from the semiconductor light-emitting device, reflected by the second reflector, focused at the second focal point of the second reflector, reflected by the third reflector, and passing through the second lens is directed in a direction at a predetermined upward angle greater than zero with respect to the horizontal plane.

2. The vehicle lighting unit according to claim 1, wherein the inclination angle of the third reflector with respect to the horizontal plane is configured such that light emitted from the semiconductor light-emitting device, reflected by the second reflector, focused at the second focal point of the second reflector, reflected by the third reflector, and passing through the second lens is directed in a direction at an upward angle of 2° to 4° with respect to the horizontal plane.

3. The vehicle lighting unit according to claim 1, wherein the distance between the first lens at its lower edge and the second lens at its upper edge in a vertical direction is 15 mm or less.

4. The vehicle lighting unit according to claim 2, wherein the distance between the first lens at its lower edge and the second lens at its upper edge in a vertical direction is 15 mm or less.

5. The vehicle lighting unit according to claim 1, wherein the narrow angle directions range within ±60° with respect to the element optical axis and the wide angle directions range outside ±60° with respect to the element optical axis.

6. The vehicle lighting unit according to claim 2, wherein the narrow angle directions range within ±60° with respect to the element optical axis and the wide angle directions range outside ±60° with respect to the element optical axis.

7. The vehicle lighting unit according to claim 3, wherein the narrow angle directions range within ±60° with respect to the element optical axis and the wide angle directions range outside ±60° with respect to the element optical axis.

8. The vehicle lighting unit according to claim 4, wherein the narrow angle directions range within ±60° with respect to the element optical axis and the wide angle directions range outside ±60° with respect to the element optical axis.

9. The vehicle lighting unit according to claim 1, wherein the element optical axis is substantially perpendicular to the first optical axis.

10. The vehicle lighting unit according to claim 1, wherein the element optical axis is substantially perpendicular to the horizontal plane.

11. The vehicle lighting unit according to claim 1, wherein the semiconductor light-emitting device includes a plurality of light emitting diodes.

12. The vehicle lighting unit according to claim 1, wherein the first lens and second lens are integral and formed with a single continuous material.

13. The vehicle lighting unit according to claim 1, wherein the first reflector and second reflector are integral and formed with a single continuous material.

14. A vehicle lighting unit, comprising:

a first lens having a first optical axis and a focal point on a vehicle rear-side of the first lens;

a second lens having a second optical axis and a focal point on a vehicle rear-side of the second lens, the first lens located above and in a vertical upward direction with respect to the second lens;

a semiconductor light-emitting device disposed on a rear side of the vehicle rear-side focal point of the first lens, the semiconductor light-emitting device configured to emit light along and about an element optical axis substantially parallel with the vertical upward direction;

a first reflector disposed above the semiconductor light-emitting device such that light emitted from the semiconductor light-emitting device in a narrow angle direction with respect to the element optical axis of the semiconductor light-emitting device is incident on the first reflector;

a shade disposed between the first lens and the semiconductor light-emitting device and configured to block part of light emitted from the semiconductor light-emitting device and reflected by the first reflector;

a second reflector disposed between the first lens and the first reflector such that light emitted from the semiconductor light-emitting device in a wide angle direction with respect to the element optical axis of the semiconductor light-emitting device is incident on the second reflector, the light emitted in the narrow angle direction and incident on the first reflector having a luminous intensity higher than does the light emitted in the wide angle direction and incident on the second reflector; and a third reflector disposed between the second lens and the vehicle rear-side focal point of the second lens, wherein the first reflector includes a revolved ellipsoidal reflector having a first focal point located substantially at the semiconductor light-emitting device and a second focal point located substantially at the vehicle rear-side focal point of the first lens, the second reflector includes a revolved ellipsoidal reflector having a first focal point located substantially at the semiconductor light-emitting device and a second focal point located between the second reflector and the third reflector, the third reflector is inclined with respect to a horizontal plane, the horizontal plane being substantially perpendicular with respect to the vertical upward direction, such that a vehicle front-side edge of the third reflector is located below the second optical axis and a vehicle rear-side edge of the third reflector is located above the second optical axis, and the third reflector includes a cross section formed as a substantially straight line inclined at an inclination angle with respect to the horizontal plane such that light emitted from the semiconductor light-emitting device, reflected by the second reflector, focused at the second focal point of the second reflector, reflected by the third reflector, and passing through the second lens is directed in a direction at a predetermined upward angle greater than zero with respect to the horizontal plane.

15. The vehicle lighting unit according to claim 14, wherein the inclination angle of the third reflector with respect to the horizontal plane is configured such that light emitted from the semiconductor light-emitting device, reflected by the second reflector, focused at the second focal point of the second reflector, reflected by the third reflector, and passing through the second lens is directed in a direction at an upward angle of 2° to 4° with respect to the horizontal plane.

16. The vehicle lighting unit according to claim 14, wherein the distance between the first lens at its lower edge and the second lens at its upper edge in a vertical direction is 15 mm or less.

17. The vehicle lighting unit according to claim 14, wherein the second focal point of the second reflector between the second reflector and the third reflector is located at a position symmetric to a position below the second optical axis with respect to the third reflector used as a symmetry plane.

18. The vehicle lighting unit according to claim 14, wherein first lens and second lens, when viewed from a front of the vehicle unit, are slightly offset in a horizontal direction from each other such that the first lens and second lens are configured at a slight angle with respect to the vertical upward direction.

* * * * *